United States Patent [19]

Cathers

[11] Patent Number: 4,587,769

[45] Date of Patent: May 13, 1986

[54] GRINDING WHEEL WEAR COMPENSATION SYSTEM

[75] Inventor: William P. Cathers, Allison Park, Pa.

[73] Assignee: PPG Industries, Inc., Pittsburgh, Pa.

[21] Appl. No.: 736,606

[22] Filed: May 21, 1985

[51] Int. Cl.[4] ..... B24B 49/00

[52] U.S. Cl. ..... 51/165.87; 51/76 R; 51/165.89; 51/283 R

[58] Field of Search ..... 51/76 R, 165.79, 165.87, 51/165.88, 165.89, 281 R, 283 R

[56] References Cited

U.S. PATENT DOCUMENTS

| | | | |
|---|---|---|---|
| 2,490,848 | 4/1948 | Vossler | 51/100 |
| 3,055,151 | 9/1962 | Salbenblatt et al. | 51/76 R |
| 3,512,306 | 5/1970 | Phillips | 51/95 |
| 3,962,831 | 6/1976 | Miki | 51/165.87 |
| 4,376,356 | 3/1983 | Everett | 51/98 |
| 4,483,103 | 11/1984 | Bickel | 51/165.87 |

*Primary Examiner*—Harold D. Whitehead

*Attorney, Agent, or Firm*—Donna L. Seidel

[57] ABSTRACT

A method and apparatus are disclosed for automatically compensating for grinding wheel wear in a continuous grinding operation.

20 Claims, 2 Drawing Figures

GRINDING WHEEL WEAR COMPENSATION SYSTEM

BACKGROUND OF THE INVENTION

The present invention relates generally to the art of grinding, and more particularly to the art of adjusting a grinding wheel to compensate for wear.

U.S. Pat. No. 2,490,848 to Vassler discloses an apparatus for simultaneously grinding a plurality of like knife frame elements. The apparatus comprises a reciprocating work table and an elongated tubular grinding wheel, cam-mounted to grind curved surfaces.

U.S. Pat. No. 3,512,306 to Phillips discloses a glass threading apparatus with a continuously rotating grinding wheel. A workpiece supported at the end of a shaft can be rotated and advanced relative to the grinding wheel. The shaft is mounted in a support mechanism which is pivotally supported about two mutually perpendicular axes so that the orientation of the shaft can be adjusted relative to the grinding wheel.

U.S. Pat. No. 4,376,356 to Everett discloses abrasive disc saws improved by means for adjusting the amount that the saw moves toward and away from the work so that the saw does not "cut air".

Large glass sheets are often coated with a metal-containing film. Various metal and metal oxide films are useful for controlling solar energy reflectance and transmittance. When such coated glass sheets are fabricated into window units, it may be desirable to remove a portion of the film along the perimeter of the coated glass surface where sealants or adhesives are applied in order to provide direct contact with the glass to prevent reaction with the film.

A preferred method for removing such a strip of film is by grinding. In general, a grinding wheel is guided along the edge of the coated surface to remove the film by abrasion. The abrasive properties of the grinding wheel are determined by the particular film to be removed. Typically, the grinding wheel should be sufficiently abrasive to remove the film without significantly affecting the underlying glass surface. The pressure on the grinding wheel is preferably kept at the minimum required to remove the film in order to minimize the rate of wear of the grinding wheel. Nevertheless, the grinding wheel surface does gradually wear away.

If the axis of a grinding wheel and coated glass are in fixed position relative to each other, eventually the grinding wheel will wear away to the extent that there will be insufficient contact with the coated glass surface to remove the film. It is well-known in the art to compensate for grinding wheel wear by raising the substrate. In the alternative, the grinding wheel and substrate are not in fixed position relative to each other. For example, the grinding wheel may be movably mounted so that as wear occurs, the wheel moves closer to the substrate. Such an arrangement may be suitable for a continuous grinding operation, but not if the grinding wheel contacts multiple spaced substrates. In that case a freely movable wheel would drop into the spaces between substrates damaging the wheel, as well as the edges of some substrates such as glass.

SUMMARY OF THE INVENTION

The present invention provides a system for automatic compensation for wear of grinding means comprising a substrate sensor, a motor-operated adjustment means, a switch and a stop to restrict the drop of the grinding wheel when not in contact with a substrate. When a new grinding means is installed and is in position over a substrate to be ground, the adjustment means is in a high initial position and the switch is not closed. Between substrates, the grinding means drops until the stop contacts the adjustment means. The switch is closed, but the sensor detects no substrate and electrically overrides the switch so that the adjustment means motor is not activated. However, as the grinding means wears and becomes smaller, eventually it will provide insufficient force on the substrate to grind the surface. At this time, the switch will be closed even when the grinding means is in contact with a substrate. When the switch is closed concurrently with the sensor detecting the presence of a substrate, the adjustment means motor is electrically activated. The adjustment means is moved to a lower position wherein the switch is no longer closed, thereby deactivating the adjustment means motor. With the adjustment means in a lower position, the grinding means can drop farther before the stop is contacted, thereby providing sufficient force to grind the substrate surface. In this way, the grinding means may be used continually as it wears to the core without stopping to make adjustments of the grinding means or substrate positions.

DESCRIPTION OF THE PREFERRED EMBODIMENTS

The present invention provides a solution to the above-identified problem of compensating for grinding wheel wear. The present invention provides means for compensating for grinding wheel wear without interrupting a grinding operation to raise the substrate position or lower the grinding wheel position. Although the grinding wheel is automatically movable in accordance with the present invention, it is not so freely movable that damage may occur to either the wheel or the substrate. In accordance with the present invention, a grinding wheel is movably, preferably pivotally, mounted on a frame. Movement is limited by a stop which may be adjusted to accommodate substrates of a particular thickness. The system of the present invention for automatically compensating for grinding wheel wear comprises a motor-driven cam, a switch which controls the cam motor, and a sensor for detecting contact between the grinding wheel and a substrate.

Figure 1:
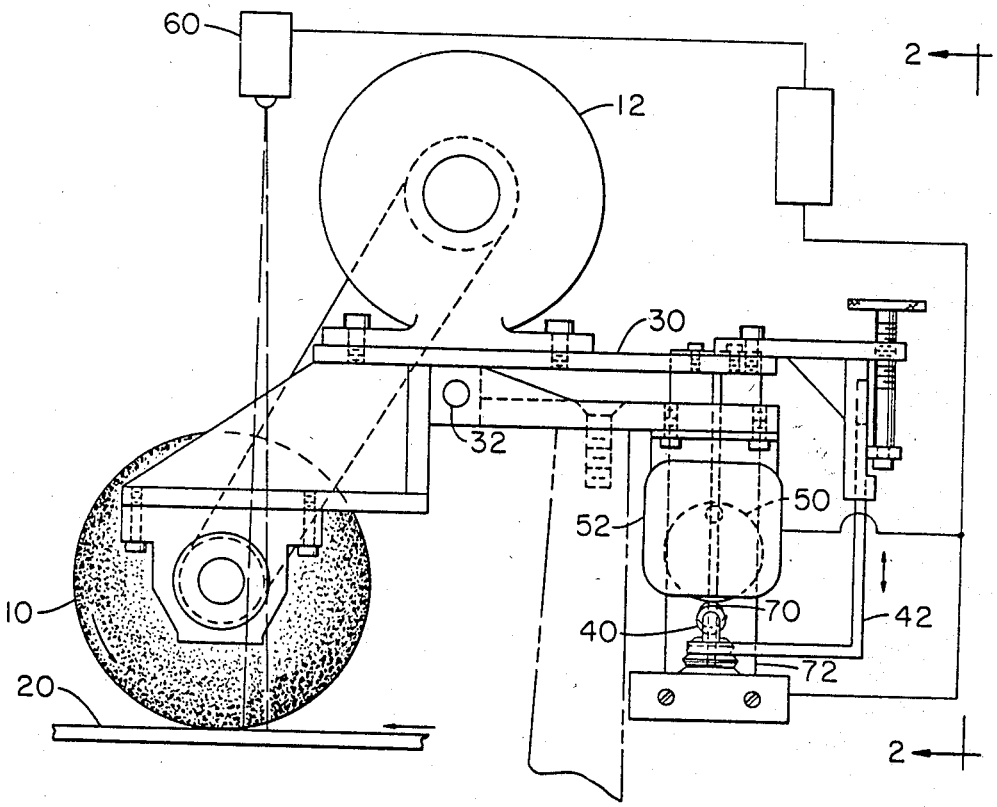
FIG. 1 is a side view of a grinding apparatus incorporating features of the present invention.
Figure 2:
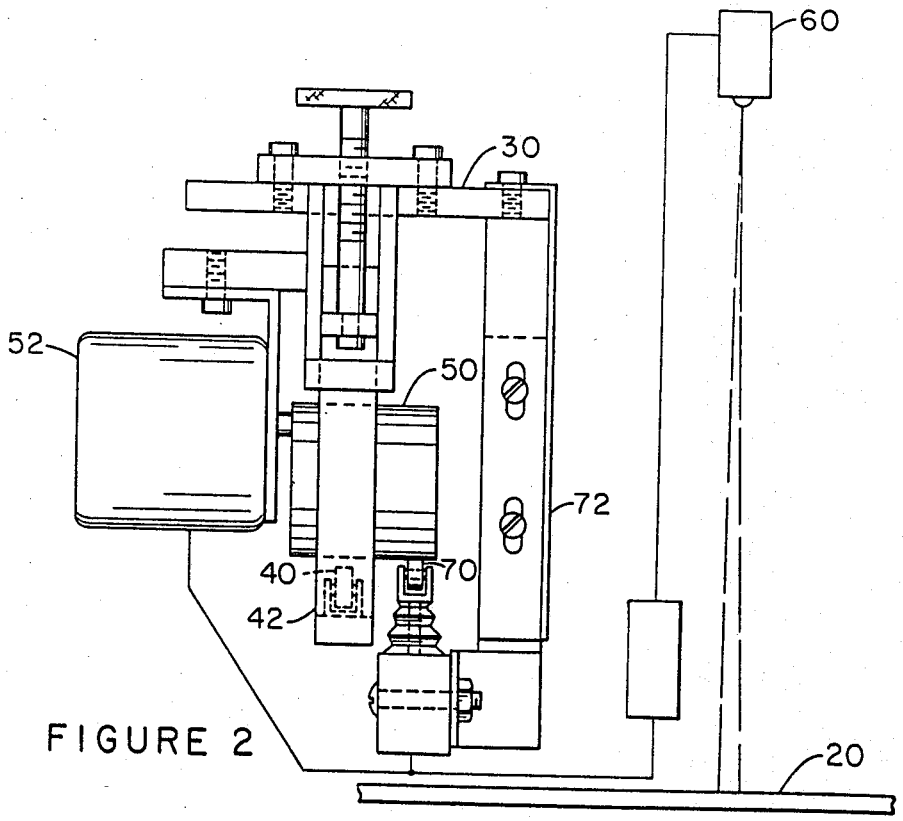
FIG. 2 is an end view of the grinding apparatus of FIG. 1, having portions removed for clarity of illustration.

Referring to the drawing, FIG. 1 is a side view of the grinding wheel 10 in contact with a substrate 20. The grinding wheel drive motor 12 is mounted on a frame 30 which pivots around a hinge point 32. Also connected to the frame 30 is a stop 40 mounted on a bracket 42 which is adjusted for the thickness of the substrate 20, so that when the grinding wheel 10 is in contact with the substrate 20, there is a small space between the stop 40 and the cam 50. When the grinding wheel 10 is not in contact with a substrate, the stop 40 contacts the cam and restricts the drop of the grinding wheel 10. A sensor 60 detects the presence of the substrate 20. FIG. 2 is a partial end view of the apparatus in FIG. 1. The cam 50 is engaged by a cam motor 52 which rotates the cam when the switch 70, mounted on a bracket 72, is closed concurrently with the grinding wheel 10 being in contact with a substrate 20 as detected by the sensor 60.

When a new grinding wheel 10 is in contact with a substrate 20 of a prescribed thickness, stop 40 is set at a position slightly spaced from cam 50, which is in its highest position. A substrate 20 is conveyed in any convenient manner, e.g., by some means such as conveyor belts or rollers (not shown), past the grinding wheel 10 which is belt-driven by a motor 12. The portion of the surface of the substrate 20 which contacts the grinding wheel 10 in passing is effectively ground. When the first substrate 20 has moved on past the grinding wheel 10, the frame 30 rotates about pivot 32, counterclockwise as viewed in FIG. 1, and the grinding wheel 10 drops into the space between consecutive substrates. However, the extent of the movement is restricted to the distance between the stop 40 and the cam 50 thereby preventing damage to the grinding wheel 10 from contacting the conveying means, and minimizing the impact of the grinding wheel 10 on the edge of an oncoming second substrate to the benefit of both.

When the grinding wheel 10 is between substrates 20, and the stop 40 is in contact with the cam 50, the switch 70 is closed. However, the sensor 60 does not detect a substrate 20, so the cam motor is not activated. As the grinding of a number of substrates wears the grinding wheel 10, eventually the switch 70 will be closed even when the grinding wheel 10 is in contact with a substrate 20. When the switch 70 is closed concurrently with the sensor 60 detecting the presence of a substrate 20 in contact with grinding wheel 10, cam motor 52 is activated thereby rotating cam 50 to a lower position until the limit switch 70 is no longer closed and the cam motor 52 is deactivated. With the cam 50 in a lower position, the grinding wheel 10 again contacts the substrate 20 with sufficient force to effectively grind.

Repeatedly as the grinding wheel 10 wears away, the switch 70 will be closed concurrently with the sensor 60 detecting the presence of a substrate 20 so that the cam motor 52 will be activated, rotating the cam 50 to a lower position thereby keeping the grinding wheel 10 effectively grinding the surface of the substrate 20. The size of the cam 50 is preferably chosen so that it reaches its lowest point when the grinding wheel 10 is worn to its core. When the grinding wheel 10 is replaced, the cam 50 is reset to its highest point. In this way, a grinding wheel can be used continuously as it wears away without interrupting the process to adjust the position of the grinding wheel or the substrate.

The present invention will be further understood in light of the specific example which follows.

EXAMPLE

Glass sheets are coated with a metal-containing reflective film. Before the glass sheets are fabricated into window units, the film is removed in a strip along the perimeter of the coated surface so that the sealant used in the unit contacts the glass instead of the film. Edge deletion of the film is effected by grinding the perimeter of the coated surface with a rotating abrasive grinding wheel driven by a motor.

Coated glass sheets are conveyed on a series of rollers to a grinding station where two grinding wheels are in position, one on each side of the glass so that parallel edges are deleted of film simultaneously. In this example, each grinding wheel is 6 inches (about 15 centimeters) in diameter. The abrasive material of each grinding wheel is Scotch-Brite® surface conditioning product from the 3M Corporation. The force on each grinding wheel on the glass surface is controlled at between two and three pounds (about 0.9 to 1.4 kilograms) by the balance of the apparatus about the pivot point. The cam of the apparatus is set at its highest point, and the stop is set at a distance of 1/16 inch (about 1.6 millimeters) from the cam when the grinding wheel is in contact with $\frac{1}{8}$ inch (3 millimeters) glass. A limit switch is mounted parallel with the stop so that the limit switch is closed before the stop contacts the cam. A photocell is mounted parallel with the grinding wheel to act as the sensor to determine whether a glass substrate is in contact with the grinding wheel. When the grinding wheel drops between consecutive glass sheets, the stop contacting the cam restricts the grinding wheel drop to about 1/16 inch. Although the limit switch is closed at this time, the photocell sensor detects no glass in contact with the grinding wheel. The photocell sensor's negative reading overrides the limit switch and prevents activation of the cam motor. As the grinding wheel deletes the edge portion of the film from a number of glass sheets, wear of the grinding wheel results in lowering of the grinding wheel until, at a sufficient degree of wear, the limit switch is closed while the grinding wheel is in contact with a substrate. When the limit switch is closed concurrently with a positive signal from the photocell sensor, the cam motor is activated. The cam rotates slightly to a lower position, just until the limit switch is no longer closed, thereby inactivating the cam motor. In its new lower position, the cam allows the grinding wheel to exert sufficient force on the substrate to effectively delete the edge portion of the film. The grinding wheel continues to delete film from the edge portions of substrates until sufficient wear again causes the limit switch to be closed concurrently with a positive signal from the photocell sensor which activates the cam motor thereby driving the cam to a still lower position. This process proceeds automatically until the cam reaches its lowest position, at which time a new grinding wheel is installed and the cam is reset. In this way, a large number of substrates may be ground without interrupting the process to raise the substrate position or lower the grinding wheel. At the same time, between substrates the grinding wheel does not drop so far as to damage the abrasive by contact with the conveyor. In addition, the rise when the grinding wheel initiates contact with a new substrate is sufficiently slight that neither the grinding wheel nor the substrate is damaged thereby.

The above example is offered only to illustrate the present invention. While the example relates to the deletion of a film from a glass substrate, the automatic wheel wear compensation system of the present invention may be employed in any grinding operation. Grinding elements other than wheels may be adjusted in accordance with the present invention. Sensors other than photocells may be readily used, and various mechanical equivalents may be substituted for the elements named herein. For example, the adjustment means may comprise a screw or piston or other adjustable element in place of the cam recited in the example. The scope of the present invention is defined by the following claims.

I claim:

1. An apparatus for grinding a substrate wherein contact between the substrate and grinding means is maintained automatically as the grinding means wears away comprising:

a. a fixed support;
b. a frame movably mounted on said fixed support;
c. grinding means mounted on said frame;
d. adjustment means mounted on said fixed support;
e. a stop mounted on said frame which restricts the movement thereof to a set distance between said stop and said adjustment means;
f. a switch mounted on said frame such that upon movement of said frame said switch is closed before said stop contacts said adjustment means;
g. means for adjusting the position of said adjustment means electrically connected to said switch; and
h. means for sensing the presence of a substrate at the position of said grinding means and electrically overriding said switch so that said means for adjusting the position of said adjustment means is activated by said switch only when said sensing means concurrently senses the presence of a substrate at the position of said grinding means.

2. An apparatus according to claim 1, wherein said grinding means comprises a grinding wheel.

3. An apparatus according to claim 2, wherein said grinding means further comprises a motor for rotating said grinding wheel.

4. An apparatus according to claim 2, wherein said grinding wheel comprises an abrasive.

5. An apparatus according to claim 4, wherein said abrasive comprises aluminum oxide.

6. An apparatus according to claim 1, wherein said sensing means comprises a photocell.

7. An apparatus according to claim 1, wherein said adjustment means comprises a cam.

8. An apparatus according to claim 7, wherein said means for adjusting the position of said adjustment means comprises a motor.

9. An apparatus according to claim 1, wherein said means for rotating said cam comprises a motor.

10. An apparatus according to claim 9, wherein said conveying means comprises a series of rollers.

11. A method for grinding a surface of a substrate and automatically compensating for wear of grinding means comprising the steps of:

a. contacting a substrate surface with grinding means;
b. providing relative motion between said substrate and said grinding means such that all the surface area to be ground is contacted by said grinding means;
c. restricting the vertical movement of said grinding means to a set distance by stop means in order to attenuate the drop of said grinding means when not in contact with a substrate;
d. sensing the presence of a substrate in contact with said grinding means;
e. engaging a switch when said grinding means drops a set distance less than the set distance required to engage said stop means;
f. activating a motor in response to said switch; and
g. adjusting the position of adjustment means by said motor to a position which disengages said switch thereby deactivating said motor, and which lowers said grinding means into effective contact with a substrate surface.

12. A method according to claim 11, wherein said substrate is contacted with a grinding wheel.

13. A method according to claim 12, wherein said grinding wheel is rotated by means of a motor.

14. A method according to claim 11, wherein a photocell senses the presence of a substrate.

15. A method according to claim 11, wherein relative motion between the substrate and grinding means is accomplished by conveying the substrate by conveying means selected from the group consisting of conveyor belts and rollers.

16. A method for edge deletion of a film from the surface of a coated substrate comprising the steps of:

a. contacting the coated surface of the substrate with grinding means;
b. providing relative movement between the coated surface and the grinding means;
c. restricting the vertical movement of said grinding means to a set distance by stop means in order to attenuate the drop of said grinding means when not in contact with a substrate;
d. engaging a limit switch when said grinding means drops a set distance less than the set distance required to engage said stop means;
e. sensing the presence of a substrate in contact with said grinding means;
f. activating a motor in response to said limit switch; and
g. rotating a cam by said motor to a position which disengages said limit switch thereby deactivating said motor, and which lowers said grinding means into effective contact with the coated surface of the substrate.

17. A method according to claim 16, wherein the substrate is glass.

18. A method according to claim 17, wherein the surface of the substrate is coated with a metal-containing film.

19. A method according to claim 18, wherein the coated surface is contacted with a rotating grinding wheel.

20. A method according to claim 16, wherein a photocell senses the presence of a substrate.

* * * * *